US005201812A

United States Patent [19]

Goss

[11] Patent Number: 5,201,812

[45] Date of Patent: Apr. 13, 1993

[54] INVESTMENT REMOVAL APPARATUS

[75] Inventor: Douglas J. Goss, North Kingstown, R.I.

[73] Assignee: Conley Casting Supply Corp., Warwick, R.I.

[21] Appl. No.: 820,293

[22] Filed: Jan. 10, 1992

[51] Int. Cl.[5] ..... B22D 29/00

[52] U.S. Cl. ..... 164/404; 164/131

[58] Field of Search ..... 164/404, 401, 131, 132, 164/260, 344, 345, 203

[56] References Cited

U.S. PATENT DOCUMENTS

| | | | |
|---|---|---|---|
| 3,162,910 | 12/1964 | Behnke et al. | 164/401 X |
| 4,185,681 | 1/1980 | Church et al. | 164/404 X |
| 4,643,243 | 2/1987 | McKibben et al. | 164/404 X |

FOREIGN PATENT DOCUMENTS

| | | | |
|---|---|---|---|
| 0326138 | 8/1989 | European Pat. Off. | 164/131 |
| 3637367 | 6/1987 | Fed. Rep. of Germany | 164/404 |
| 59-125263 | 7/1984 | Japan | 164/404 |
| 929318 | 5/1982 | U.S.S.R. | 164/401 |
| 1389934 | 4/1988 | U.S.S.R. | 164/404 |
| 2067938A | 8/1981 | United Kingdom | 164/344 |

*Primary Examiner*—J. Reed Batten, Jr.

*Attorney, Agent, or Firm*—Salter, Michaelson, Benson

[57] ABSTRACT

The apparatus for removing investment material from an investment flask casting includes a spring-biased seating assembly, a centering assembly having spring-biased shoulder mounts, a vertical impact assembly, and a pair of opposing horizontal impact assemblies. The vertical and horizontal impact assemblies work simultaneously and in combination with the spring-biased seating assembly and the spring-biased shoulder mounts to transmit linear dynamic and high frequency vibratory impact energy to the investment flask casting wherein the apparatus effectively and quickly removes virtually all of the investment material therefrom. The investment apparatus further includes an investment collection system for collecting waste investment material for subsequent disposal.

10 Claims, 4 Drawing Sheets

INVESTMENT REMOVAL APPARATUS

BACKGROUND OF THE INVENTION

The instant invention relates generally to lost wax investment casting, and more specifically to apparatus for removing investment material from an investment casting.

The lost wax investment casting process is used in the molding of high temperature metals that cannot be molded in rubber. In casting by the lost wax process preliminary patterns of the parts to be cast are formed by any suitable means, such as rubber molds, from a meltable material such as wax or the like. For example, the wax materials may be introduced into a rubber mold having the desired pattern cavities under high temperature and pressure to produce the desired wax patterns, and thereafter the wax is allowed to cool. After cooling, the wax patterns are removed from the mold and attached to a wax trunk or rod by their runners or gates, thereby forming a tree-shaped wax model. The wax tree model is placed on a circular rubber base and a cylindrical metal flask is then slid over the base. The wax tree is then embedded in a gypsum-based investment material which comprises a gypsum-based powder mixed with water. More specifically, the investment material is mixed, evacuated to remove air pockets, and then poured into the top of the cylinder completely embedding the wax tree therein, and thereafter the investment is allowed to solidify. After the investment solidifies, the wax is removed from the investment flask mold by placing the flask in an oven where the wax is melted and burnt out, leaving the investment flask mold with the desired pattern cavities therein. Casting metal is then introduced into the mold by vacuum or centrifugal techniques, and thereafter, the metal is allowed to harden.

After the metal is hardened, the investment material must be removed from the cylindrical flask and separated from the cast metal tree and parts. Heretofore, investment removal has primarily been accomplished by high pressure water blasting in which high pressure air and water are applied to the ends of an investment flask which is maintained at an elevated temperature. The high pressure of the water and air function to blast away the investment material from the cast parts, and the elevated temperature of the flask creates a steam effect when the water is introduced, thus helping to disintegrate the investment. The cast parts are thereafter sandblasted to remove any remaining investment material after which conventional final finishing operations are employed. Although the water blasting method has proven to be generally satisfactory, the introduction of water to the investment material causes several disposal problems which are readily apparent. The introduction of water to the investment material increases the weight of the waste investment and thus increases disposal costs. In order to dispose of the saturated investment material the investment must be separated from the water in settling tanks, and this alone is a lengthy and difficult process. In addition, the investment material may contain trace elements of toxic metal from the casting process, and in turn, waste water from the settling process may contain traces of investment material. Therefore, both the investment material and the waste water must be appropriately disposed of so as to not create environmental concerns.

Investment removal has also been accomplished using dry processes in which the investment mold is pushed out of the flask and then manually pounded to break away and separate the investment material from the cast metal parts. Several problems are readily apparent in the above-described procedure. Manually separating the cast parts is labor intensive and introduces a high degree of risk of damaging the cast parts. In addition, there is also a high percentage of investment left on the parts after manual separation, and thus the parts require more sandblasting than with the wet process. For all of the foregoing reasons, the existing investment removal techniques have been found to be inadequate.

SUMMARY OF THE INVENTION

The instant invention provides an improved apparatus for investment removal which quickly and cleanly removes virtually all of the investment material from an investment flask casting. Briefly, the invention comprises a dual-axis vibratory impact device, and means for collecting the investment dust and debris. The vibratory impact device comprises a spring-biased flask seat, a flask centering assembly having spring biased shoulder mounts adapted for engaging the flask wall and centering the flask on the seating assembly, a vertical pneumatic impact hammer assembly adapted for engaging the top of the casting trunk and inducing vertical vibratory impact on the casting, and opposing horizontal pneumatic impact hammer assemblies mounted on the centering assembly and adapted for engaging the outer wall of the flask and inducing horizontal vibratory impact on the flask. The seating, centering, and impact assemblies of the impact device are mounted on a common horizontal base and enclosed by an acoustical housing.

The seating assembly generally comprises a vertically disposed stub shaft mounted on the base with a spring-loaded casting trunk receptor supported by the shaft.

The centering assembly generally comprises four traveler assemblies mounted in opposing pairs on the base and centered about the vertical axis of the seating assembly. Each of the traveler assemblies comprises a guide rail mounted to the base, a traveler bushing slidingly mounted thereon, a hydraulic cylinder adapted for actuating the traveler bushing along the guide rail, and a reaction upright. Each of the reaction uprights includes two spring-biased shoulder mounts, each of which generally comprises a shoulder bolt which extends through the reaction upright and which is adapted for engaging the wall of an investment flask, a coil spring biasing the bolt, and a nut. The hydraulic cylinders of the traveler assemblies are controlled by a common hydraulic source so as to induce equal and simultaneous movement of the traveler assemblies.

The two horizontal pneumatic impact devices are mounted on opposing reaction uprights and each comprises a pneumatic hammer having an impact punch, a compression spring, and tension springs. The impact punch passes through the compression spring and extends through the reaction upright. The hammer is held in position by the tension springs which react against the reaction upright to bias the hammer inwardly.

The vertical pneumatic assembly is carried on a vertical guide assembly which is attached to the base. The vertical impact assembly is carried on a horizontal carrier arm and comprises a pneumatic hammer having an impact punch, a vertical guide bushing, and tension springs. The impact punch is aligned along the vertical axis of the seating assembly and extends through the carrier arm and the vertical guide bushing. The impact hammer is held in position by the tension springs which react against the carrier arm to bias the hammer downwardly. The vertical guide assembly is operative for moving the entire vertical impact assembly up and down along the vertical axis of the seating assembly.

The investment collection system preferably comprises an annular collection pan centered under the seating assembly, a conical dust and debris guide in the center hole of the annular pan, a retainer wall extending vertically downward from the bottom of the collection pan, a waste drum aligned under the debris guide and releasably connected to the retainer wall, and a dust collector attached to the retainer wall through an exhaust hole therein.

During operation, an investment flask casting is seated on the trunk receptor of the seating assembly and the apparatus is activated. The impact punch of the vertical impact assembly is actuated into engagement with the top of the trunk of the casting and simultaneously the traveler assemblies of the centering assembly are actuated inwardly bringing the shoulder mounts and the horizontal impact assemblies into engagement with the wall of the flask. Thereafter, the vertical and horizontal impact hammers simultaneously become active and work in combination with the energy return spring of the seating assembly and the springs of the shoulder mounts to induce horizontal and vertical vibratory impact, causing the flask to resonate and vibrate and thereby causing the investment material to break, crumble and disintegrate. The investment debris falls from the flask, through the debris guide and into the waste drum and the dust is drawn off into the dust collector through the exhaust duct by suitable suction means.

It is therefore an object of the instant invention to provide a vibratory impact apparatus for removing investment material from an investment flask casting.

It is another object of the instant invention to provide an investment removal apparatus which simultaneously induces vertical and horizontal vibratory impact on an investment flask casting.

It is a further object of the instant invention to provide an investment removal apparatus which quickly (in less than a minute) removes virtually all of the investment material from an investment flask casting without the introduction of water.

It is an even further object of the invention to remove investment material without labor intensive procedures.

It is a still further object of the instant invention to provide a self-contained investment removal apparatus which collects waste investment material and dust.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

Figure 1:
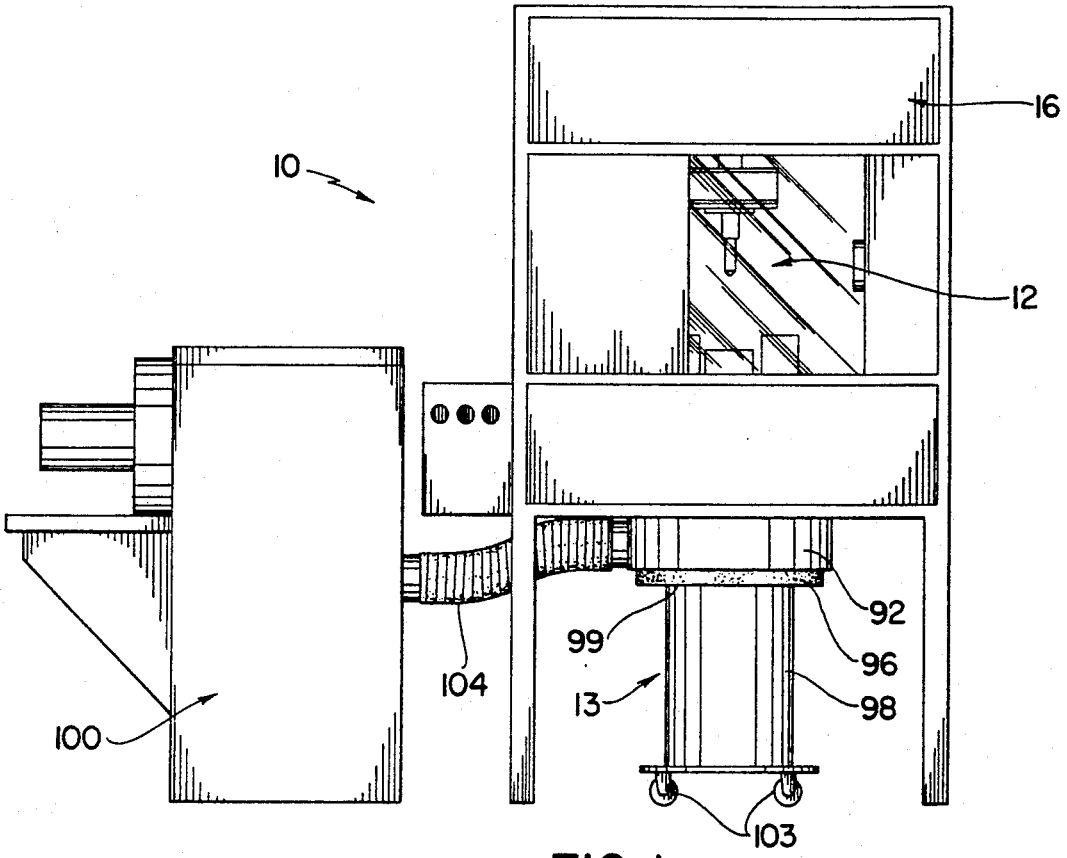
FIG. 1 is a side elevational view of the investment removal apparatus of the instant invention.
Figure 2:
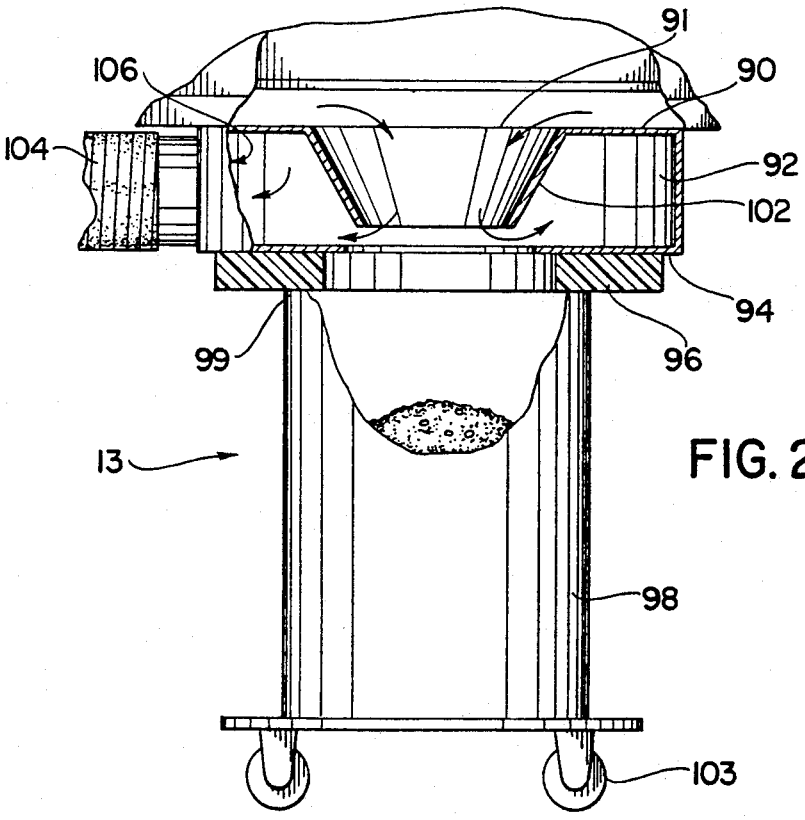
FIG. 2 is a fragmentary side elevational view, partially in section, of the waste collection means which form a part thereof.

Referring now to the drawings, the investment removal apparatus is illustrated and generally indicated at 10 in FIG. 1. The invention comprises a dual-axis vibratory impact device generally indicated at 12 (FIG. 3), and includes an investment collection system generally indicated at 13 (FIG. 2).

The impact device 12 is mounted on a rigid horizontal base generally indicated at 14 which is mounted within an acoustical housing generally indicated at 16. The base 14 preferably comprises two longitudinal members 17 and three cross members 18. The longitudinal members are mounted within the housing 16 on shock mounts 19.

The acoustical housing 16 is designed to enclose the impact device and provide acoustical insulation from the vibratory impact noise of the device during operation.

Figure 3:
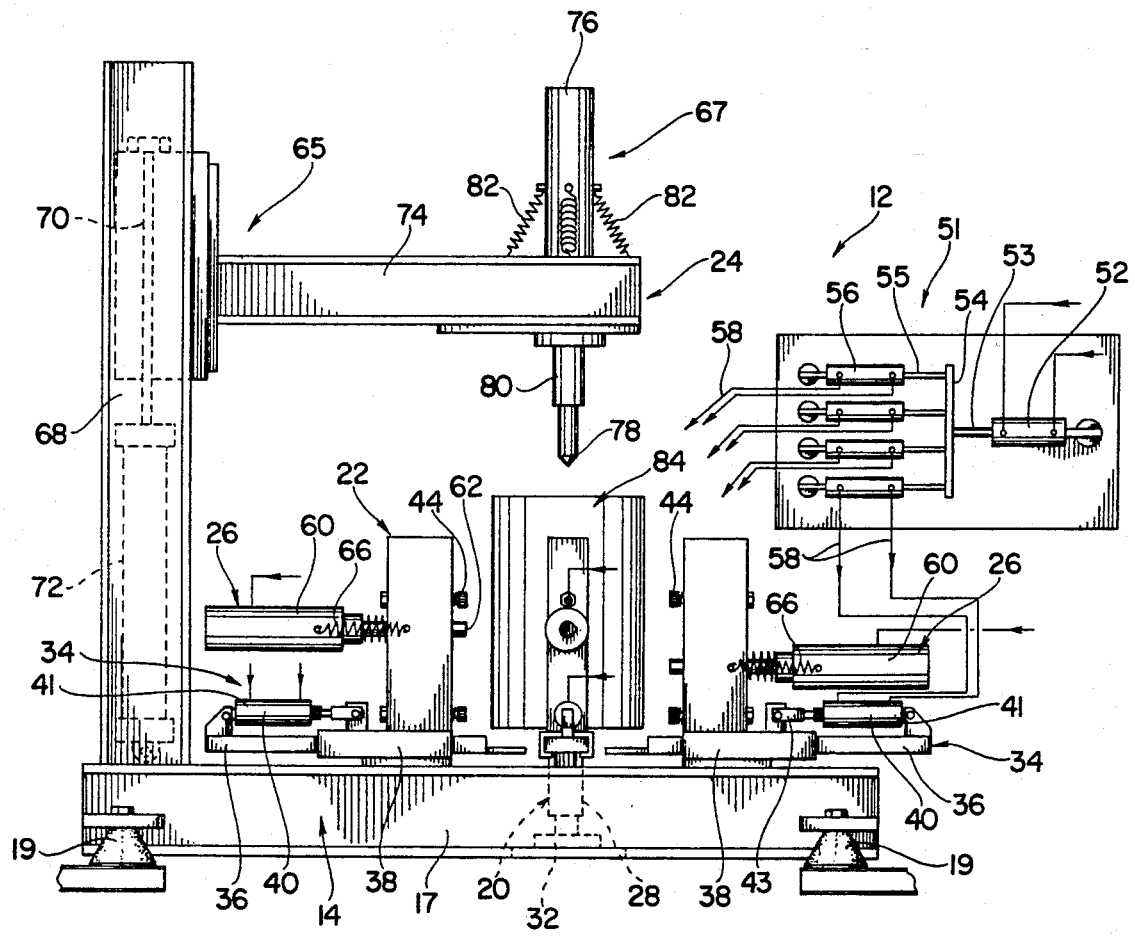
FIG. 3 is an elevational view of the investment removal apparatus with the outer cover removed.
Figure 4:
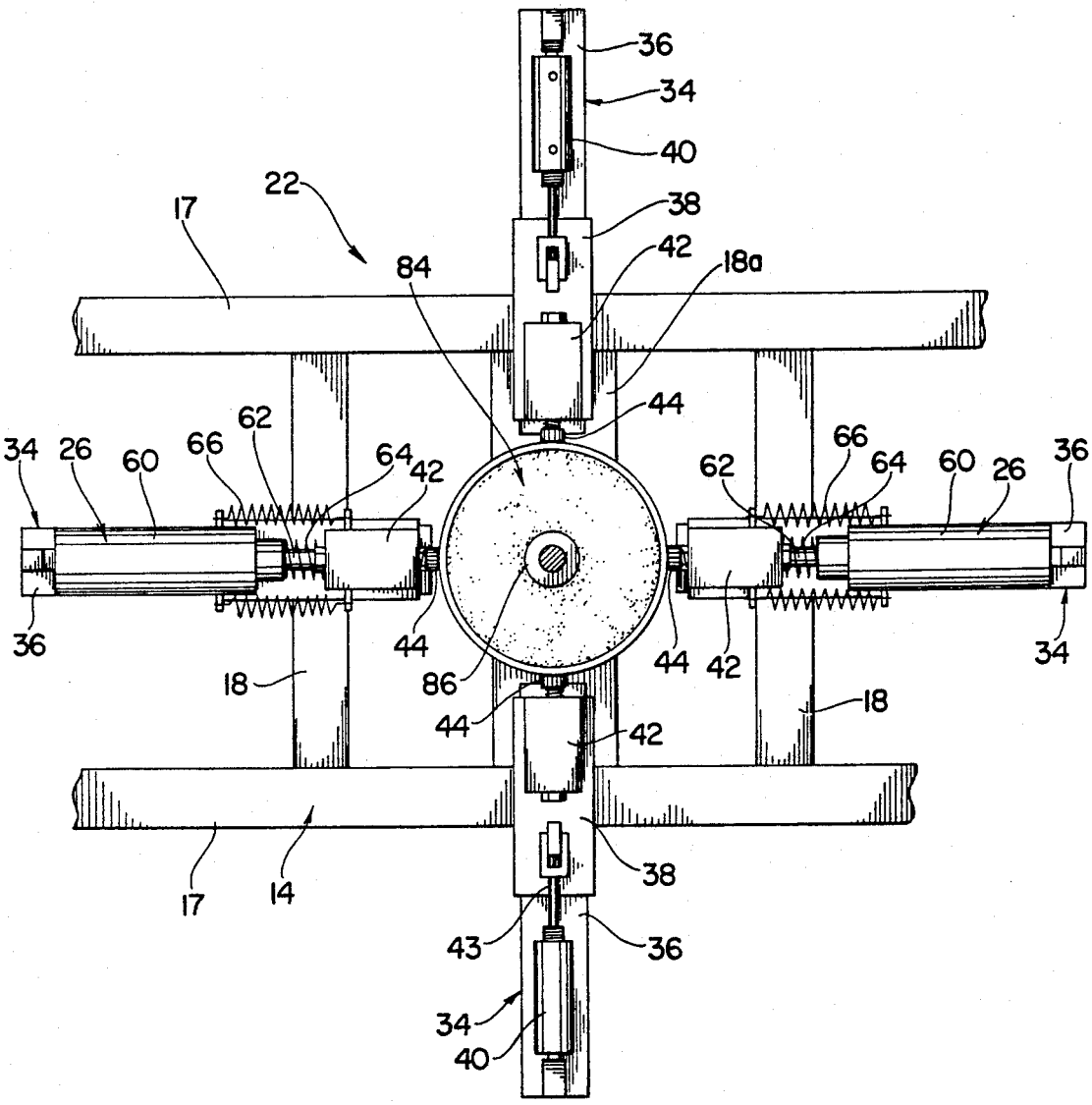
FIG. 4 is a fragmentary top plan view thereof showing the flask centering assembly.
Figure 5:
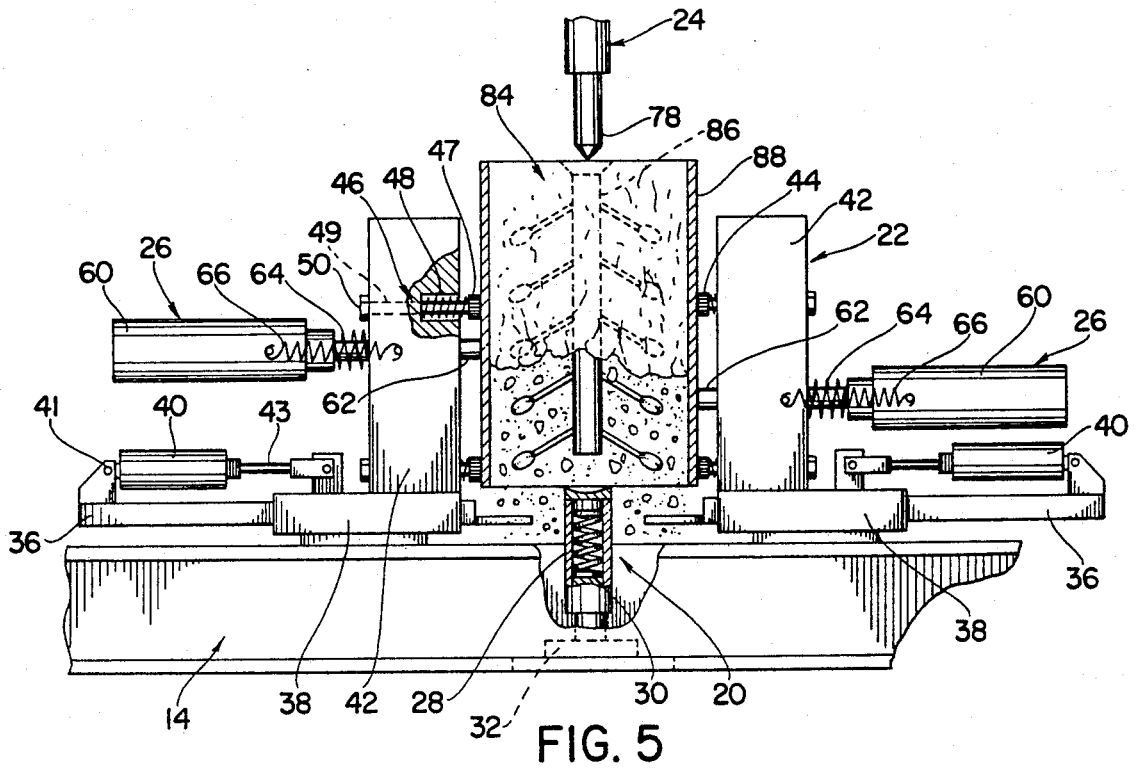
FIG. 5 is a fragmentary elevational view thereof, partially in section, showing the flask seating assembly, the flask centering assembly, and the pneumatic impact devices.
Figure 6:
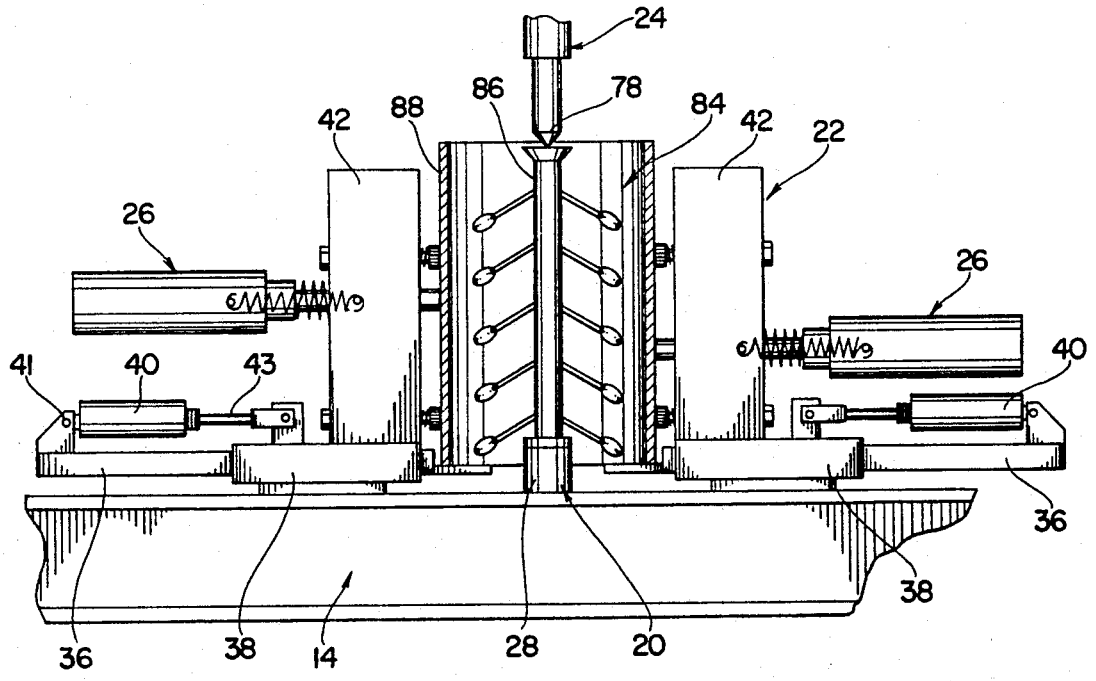
FIG. 6 is a view similar to FIG. 5 showing the flask after the investment material has been removed.

As shown most clearly in FIG. 3, the impact device 12 generally comprises a casting seat assembly generally indicated at 20, a flask centering assembly generally indicated at 22, a vertical impact hammer assembly generally indicated at 24, and opposing horizontal impact hammer assemblies generally indicated at 26.

The casting seat assembly 20 extends perpendicularly upwardly from the central cross member **18*a* of base 14 and defines a vertical impact axis perpendicular thereto. The seating assembly comprises a casting trunk receptor 28 supported on an energy return spring 30 which is seated on a stub shaft 32. Stub shaft 32 is fixedly attached to cross member 18*a*** by any suitable means, such as welding.

The flask centering assembly 22 is mounted on base 14 and comprises four traveler assemblies generally indicated at 34, each of which comprise a guide rail 36, a traveler bushing 38, a hydraulic cylinder 40, a reaction upright 42, and a pair of spring-biased shoulder mounts 44. The guide rails 36 are preferably mounted in opposing pairs on the two longitudinal members 17 and the two outer cross members 18 of the base 14 by any suitable means, and are effectively centered about the seating assembly 20 forming a pair of horizontal axes intersecting about the vertical axis of the seating assembly 20. The traveler bushings 38 are slidably mounted on each of the guide rails 36 by any suitable means and are actuated along the guide rails 36 by the hydraulic cylinders 40. The hydraulic cylinders 40 are connected to the guide rails 36 by any suitable means, such as by pin and bracket assemblies 41, and the piston rods 43 thereof are connected to the traveler bushings 38 by similar means. Reaction uprights 42 are relatively massive so as to achieve a counterweight-like effect and are attached to the traveler bushings 38 by any suitable means, such as welding, and extend vertically upwardly therefrom. Mounted within each of the reaction uprights 42 is a pair of spring-biased shoulder mounts 44, each of which comprises a shoulder bolt 46, a spring 48, and a nut 50. Shoulder bolt 46 has a shoulder portion 47 adapted for engaging the outer flask wall of an investment flask and a shaft portion 49 which passes through spring 48 and extends through reaction upright 42. The shoulder bolt 46 is secured therein by nut 50.

The hydraulic cylinders 40 are controlled by a common hydraulic source generally indicated at 51 which comprises a master cylinder 52, a guide bar 54, and four slave cylinders 56. The piston rod 53 of the master cylinder 52 is connected to guide bar 54 and the piston rods 55 of the slave cylinders 56 are also connected to the guide bar 54 such that movement of the piston rod 53 of the master cylinder 52 causes equal and simultaneous movement of the rods 55 of the slave cylinders 56. Hydraulic lines 58 run from the slave cylinders 56 to the hydraulic cylinders 40 and thus cause equal and simultaneous movement of the traveler assemblies 34.

The horizontal impact assemblies 26 are preferably mounted on opposing reaction uprights 42, and each preferably comprises a pneumatic hammer 60 having an impact punch 62, a compression spring 64, and tension springs 66. The impact punch 62 of hammer 60 passes through the compression spring 64 and extends through the reaction upright 42. The hammer 60 is held in position by the tension springs 66 which react against the reaction upright 42 to bias the hammer 60 inwardly.

The vertical impact assembly 24 preferably comprises a vertical guide assembly generally indicated at 65 and a pneumatic impact assembly generally indicated at 67. The vertical guide assembly 65 is preferably attached to base 14 by means of vertically disposed guide rails 68 which carry vertically reciprocating housing 70, movement of which is achieved by an air-over-oil hydraulic cylinder system 72. Guide rails 68 are fixedly attached to base 14 by any suitable means, such as welding, and extend vertically upwardly therefrom. A carriage arm 74 extends horizontally outwardly from the guide rails 68 parallel to the base 14 and is secured to vertically reciprocal housing 70. The carriage arm 74 thus travels vertically up and down in response to vertical movement of housing 70 pursuant to operation of cylinder 72 and is operative for moving the vertical impact assembly 67 along the same vertical axis as that of the seating assembly 20.

The vertical pneumatic impact assembly 67 is carried on carriage arm 74 and comprises a pneumatic hammer 76 having an impact punch 78, a vertical guide bushing 80, and tension springs 82. Impact punch 78 further extends through vertical guide bushing 80 aligned therewith. Pneumatic hammer 76 is held in position by tension springs 82 which react against carriage arm 74 to bias the impact hammer 76 downwardly.

The hydraulic cylinder 72 of the vertical guide assembly 65, the master cylinder 52, the horizontal pneumatic hammers 60, and the vertical pneumatic hammer 76, are all operated by means of a common compressed air supply (not shown). Air pressure to the hydraulic cylinder 72 and the master cylinder 52 is controlled by a single solenoid valve so that they are operated simultaneously. Air pressure to the pneumatic hammers 60 and the vertical pneumatic hammer 76 is controlled by two separate air piloted valves so that they may be operated separately. The apparatus is controlled by an electronic timer control means (not shown) which is located within the housing 16.

In operation, an investment flask casting 84 is aligned on the seating assembly 20, the trunk 86 of the casting 84 being aligned with the trunk receptor 28. The apparatus is activated by depressing a removal cycle start switch which activates the cycle timer. A complete removal cycle is approximately 1 minute long. When the timer contacts are closed the solenoid valve is shifted to supply air pressure to the hydraulic cylinder 72 and the master cylinder 52. Pressurized cylinder 72 begins to retract and the impact punch 78 of the vertical impact assembly 67 is lowered into engagement with the top of the trunk 86 of the flask 84. The impact punch 78 is biased downwardly toward the top of the flask trunk 86 due to the tension springs 82 reacting through carriage arm 74. Simultaneously, the pressurized master cylinder 52 causes the hydraulic cylinders 40 to actuate the traveler assemblies 22 inwardly until the spring-loaded shoulder mounts 44 and the impact punches 62 of horizontal impact assemblies 26 engage the outer wall 88 of the flask 84 and center the flask 84. The impact punches 62 are biased inward towards the flask wall 88 due to the tension springs 66 reacting through the reaction uprights 42, and the springs 48 of the shoulder mounts 44 serve to compress and adjust for irregularities in the flask wall.

After a preset delay period to allow engagement and centering of the flask, the timer opens both of the air piloted valves to simultaneously operate the horizontal and vertical pneumatic hammers. The vertical and horizontal impact assemblies 24 and 26 work together to apply vibratory impact energy to the investment casting and cause the investment material contained therein to break, crumble, and disintegrate. The springs 48 of the shoulder mounts 44 allow the flask to vibrate and resonate in response to the impact forces applied by the horizontal impact assemblies 26. Compression springs 64 serve to limit travel of impact punches 62, and also to de-couple the impact of the hammer assemblies 26 in a non-loaded condition. The large mass of the reaction uprights 42 serves to dampen the transmission of the impact forces generated by the impact hammers 60 into the casting cylinder 84. The horizontally generated impact forces react against reaction uprights 42 to induce linear dynamic and high frequency impact energy to the wall 88 of investment casting 84 held between the impact punches 62 and shoulder mounts 44. Energy return spring 30 of seating assembly 20 develops a resistance force against the impact energy of the vertical impact punch 78 and allows the flask to resonate and vibrate in response to impact energy applied by the impact punch 78. The vertically generated impact forces react against base 14 to induce linear dynamic and high frequency impact energy to the trunk 86 of investment casting 84 held between the impact punch 78 and trunk receptor 28.

The combined horizontal and vertical impact energy quickly and effectively removes virtually all of the investment material from the flask and casting located therein within a minute's time. After completion of the impact cycle, the timer closes the air piloted valve controlling the horizontal impact assemblies 26, thus shutting them off. The vertical impact hammer 67 continues to operate for the remainder of the removal cycle. Upon completion of the remainder of the removal cycle, the timer shuts off the vertical impact assembly and shifts the solenoid valve back to its original position, thus retracting the centering assembly and extending the vertical impact assembly. The casting 86 may then be removed from the apparatus after which conventional finishing operations such as sandblasting are employed.

Referring now to FIGS. 1 and 2, the investment collection system generally indicated at 13 comprises a collection pan 90, a retainer wall 92, a ring 94, an annular seal 96, and a waste drum 98. A dust collector 100 is provided to vent away floating dust and debris.

The collection pan 90 is preferably fashioned from a suitable, durable metal, such as stainless steel, and is centered under the impact device. The pan is preferably of annular shape having a center hole 91 and a conical debris and dust guide 102 extending downwardly therefrom. Retainer wall 92 extends downwardly from the peripheral edge of pan 90 and then inwardly to define the ring 94, which has a central opening in alignment with the bottom of guide 102. Seal 96 is preferably formed from an elastomer foam and is attached to the bottom of ring 94 by any suitable means. Waste drum 98 is preferably mounted on rollers 103 and is positioned beneath foam seal 96, the rim 99 thereof making pressurized engagement with the foam seal 96 to form a tight seal therebetween. When drum 98 becomes full, it may easily be wheeled away, emptied, and then returned to its operative position.

Dust collector 100 has a vacuum source and is coupled to the retainer wall 92 of the collection system 13 through a flexible exhaust duct 104 connected to an exhaust hole 106 in the retainer wall 92.

As investment material breaks and crumbles away from the flask 84 during the removal cycle, it falls into the collection pan 90, through the debris guide 102, and into the waste drum 98. Airborne dust particles are vented away through the exhaust hole 106 in retainer ring 92 by the dust collector 100.

It is seen therefore that the instant invention provides an efficient investment removal apparatus which removes virtually all of the investment material from an investment flask casting within one minute, and without the use of any water. The apparatus is specifically adapted for inducing simultaneous vertical and horizontal vibratory impact on the investment material thereby causing the investment material to break, crumble and disintegrate. The apparatus accomplishes the removal of investment material without the introduction of water, and also without labor intensive manual procedures. For these reasons it is believed that the present invention represents a significant improvement in the investment removal art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. Investment removal apparatus for removing investment material from a tree-shaped investment casting having a central trunk and a plurality of cast parts which are connected to said trunk by a plurality of gates, said investment casting being cast within an open-ended cylindrical flask having an investment mold therein, said apparatus comprising:

a) spring-biased seating means for receiving a first end of said central trunk when said flask is vertically disposed on said seating means;

b) centering means having spring-biased shoulder mounts for engaging said flask at spaced circumferential locations for centering and holding said flask so that said central trunk is in vertical alignment with said seating means;

c) horizontal impact means in engagement with said flask for imparting horizontal vibratory impact to said flask whereby said spring-biased shoulder mounts cause said flask to resiliently resonate in a horizontal direction;

d) vertical impact means in engagement with a second end of said central trunk for imparting vertical vibratory impact thereto whereby said spring-biased seating means cause said investment casting to resiliently resonate in a vertical direction, said horizontal and vertical vibratory impacts cooperating to cause said investment material to break, crumble and disintegrate.

2. The apparatus of claim 1, wherein said seating means comprises a casting trunk receptor for receiving said first end of said central trunk and an energy return spring supporting said receptor.

3. The apparatus of claim 1, wherein said centering means comprises a plurality of slidable reaction uprights arranged in opposing pairs about said seating means.

4. The apparatus of claim 1, wherein said horizontal impact means comprises a pneumatic impact hammer and an impact punch which is adapted for engaging said flask.

5. The apparatus of claim 3, wherein said horizontal impact means comprises a pair of pneumatic impact hammers each having an impact punch which is adapted for engaging said flask, said pneumatic hammers being mounted on opposing reaction uprights and said impact punches extending through said reaction uprights.

6. The apparatus of claim 1, wherein said vertical impact means comprises:

a pneumatic hammer and an impact punch adapted for engaging said second end of said central trunk.

7. The apparatus of claim 1, further comprising acoustic housing means operative for enclosing said seating means, said centering means, said horizontal impact means, and said vertical impact means, and damping the sound thereof.

8. The apparatus of claim 1, further comprising waste collection means.

9. The apparatus of claim 8, wherein said waste collection means comprises:

an annular collection pan having a center hole therein, and a conical debris guide in said center hole, said collection pan being aligned under said seating means;

a retaining wall extending vertically downwardly from a bottom side of said collection pan;

and a waste drum aligned under said debris guide and releasably connected to said retaining wall.

10. The apparatus of claim 9, further comprising a vacuum dust collector coupled to said retaining wall through an exhaust hole therein.

* * * * *